US005971352A

United States Patent [19]

Kirks

[11] Patent Number: 5,971,352

[45] Date of Patent: Oct. 26, 1999

[54] ICE BAR TRAY

[76] Inventor: Kelly Kirks, 1727 S. Gilpin St., Denver, Colo. 80210

[21] Appl. No.: 09/074,737

[22] Filed: May 8, 1998

Related U.S. Application Data

[60] Provisional application No. 60/056,449, Aug. 19, 1997.

[51] Int. Cl.[6] ..... B29C 33/44

[52] U.S. Cl. ..... 249/117; 249/119; 249/127; 249/131; 249/158; D15/90

[58] Field of Search ..... 249/117, 119, 249/127, 129, 131, 158; D15/90

[56] References Cited

U.S. PATENT DOCUMENTS

| | | | |
|---|---|---|---|
| 910,620 | 1/1909 | Wert | 249/158 |
| 2,049,902 | 8/1936 | Pischer | 249/121 |
| 2,326,546 | 8/1943 | McDonald | 249/119 |
| 2,411,193 | 11/1946 | Cummins | 249/119 |
| 2,729,947 | 1/1956 | Cheney | 249/121 |
| 2,819,690 | 1/1958 | Baker | 249/119 |
| 3,290,721 | 12/1966 | Siegal | 249/82 |
| 3,565,389 | 2/1971 | Price | 249/121 |
| 3,815,851 | 6/1974 | Girard | 249/121 |
| 3,836,111 | 9/1974 | Binder | 249/121 |
| 4,417,716 | 11/1983 | Penna et al. | 249/121 |
| 4,970,949 | 11/1990 | Ferrar, Jr. et al. | 249/121 |

*Primary Examiner*—James P. Mackey
*Attorney, Agent, or Firm*—Edwin H. Crabtree; Ramon L. Pizarro; Donald W. Margolis

[57] ABSTRACT

An ice bar tray for making various lengths of ice bars for use in different types and sizes of water bags. Each ice bar has a round cross section for ease in inserting into circular water fill openings in a water bag. The ice bar tray includes at least one elongated bar cylinder with a tray handle on each end. The bar cylinder has an elongated cylinder opening in a top of the cylinder for receiving water into a water channel. The water channel has a circular cross section. The water channel is disposed along a length of the elongated cylinder. When the water channel is filled with water and the water frozen, a round ice bar is formed therein. By flexing the ice bar tray, which is made of a flexible PVC plastic material and the like, the frozen ice bar is released outwardly from the water channel and through the cylinder opening. The ice bar is then inserted into the water fill opening in the water bag. The ice bar tray also includes a tray slide with at least one cylinder divider. By sliding the tray slide along the length of the water channel, the cylinder divider allows the user of the ice bar tray to make various lengths of ice bars. While an ice bar has a round cross section, it may also be formed having a half-round cross section or three-quarter round cross section.

10 Claims, 1 Drawing Sheet

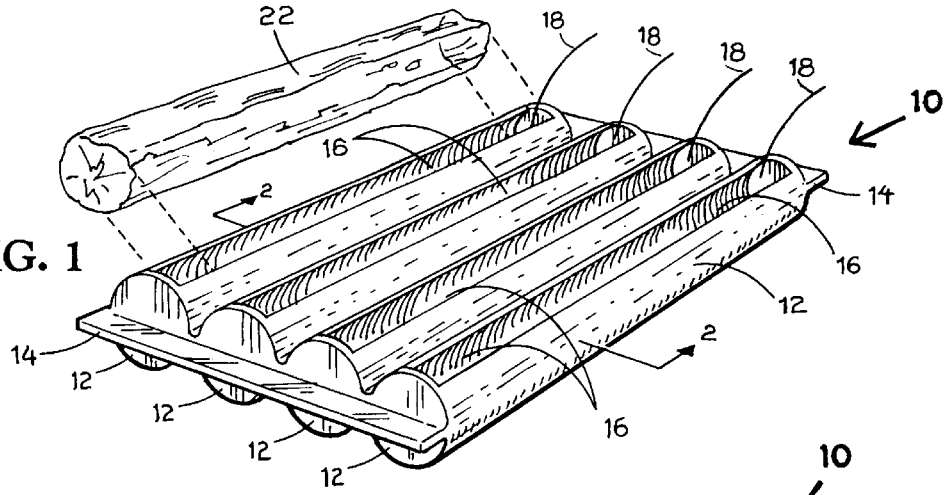
FIG. 1
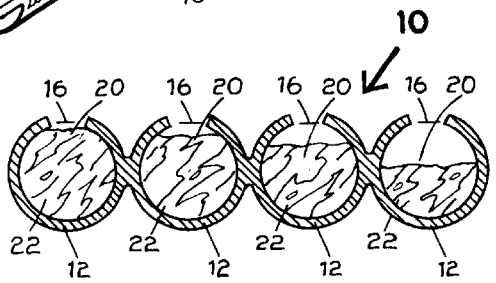
FIG. 2
FIG. 3
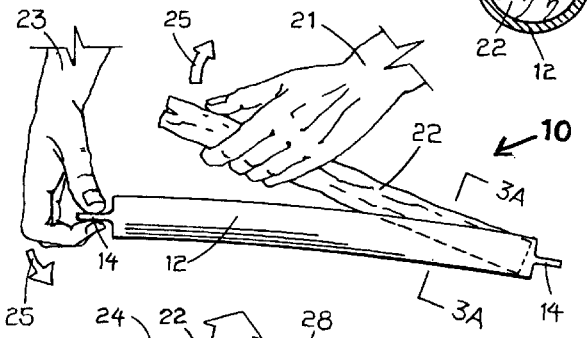
FIG. 3A
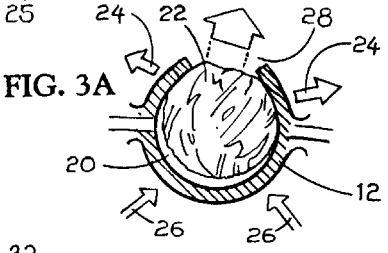
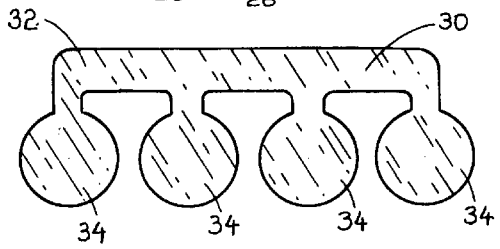
FIG. 4
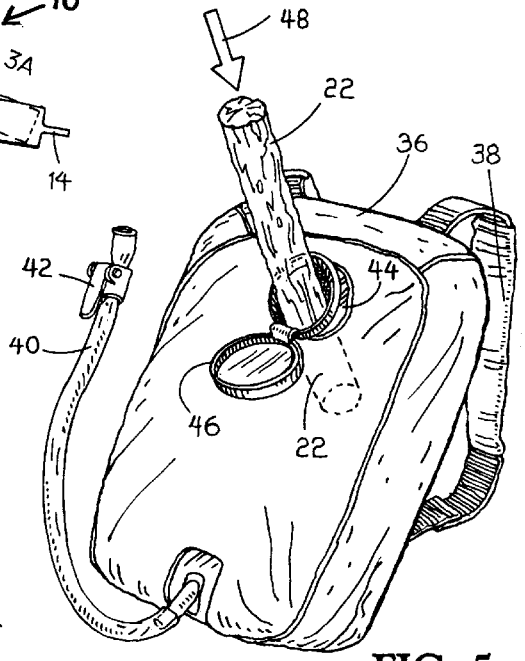
FIG. 5

ICE BAR TRAY

This application is a utility patent application based on a previously filed provisional patent application as established in the U.S. Patent and Trademark Office on Jun. 8, 1995. The provisional patent application was filed in the Patent Office on Aug. 19, 1997, Ser. No. 60/056,449 and having the same title.

BACKGROUND OF THE INVENTION (a) Field of the Invention

This invention relates to trays for making ice and more particularly, but not by way of limitation, to a ice bar tray for making various lengths, sizes and cross sections of ice bars.

(b) Discussion of Prior Art

Heretofore, there have been a variety of different types of metal and plastic ice trays for making different sizes and shapes of ice cubes.

In U.S. Pat. No. 2,434,803 to Johnson et al., an ice tray is illustrated. The ice tray is used to mold narrow ice sticks for inserting into a thermos and the like. In U.S. Pat. No. 2,796,742 to Platt, a plastic ice tray is described for making ice blocks. The ice blocks are elongated half-cylinders. In U.S. Pat. No. 3,214,128 to Beck et al., an improved plastic ice tray is described and used for improving the freezing rate of a liquid. U.S. Pat. Des. No. 202,529 to Rosebrook illustrates a new design of an ice tray for making elongated ice sticks.

None of the above mentioned patents and prior art ice trays provide the unique combination of structure and function of the subject ice bar tray used for making circular ice bars for a water bag, a water bottle and water holding devices with the objects and advantages as described herein.

SUMMARY OF THE INVENTION

In view of the foregoing, it is a primary object of the present invention to provide an ice bar tray for making ice bars having a round cross section, a three-quarter round cross section and a half-round cross section.

Another object of the invention is to provide an ice bar tray that will make ice bars with an increased surface area for providing additional cooling of water over an extended period of time. The ice bars are adapted by the nature of their cross section to be received through circular fill openings in water bags, water bottles and other types of containers used for holding water and other liquids.

Yet another object of the invention is to provide an ice bar tray with a cylinder divider that will allow the user of the tray to make ice bars of different lengths.

The subject invention includes at least one elongated bar cylinder with a tray handle on both ends. The bar cylinder has an elongated cylinder opening in a top of the cylinder for receiving water into a water channel. The water channel has a circular cross section. The water channel is disposed along a length of the elongated cylinder. When the water channel is filled with water and the water frozen, a round ice bar is formed therein. By flexing the ice bar tray, which is made of a flexible PVC material and the like, the frozen ice bar is released outwardly from the water channel and through the cylinder opening. The ice bar is then inserted into the water fill opening in the water bag. The ice bar tray also includes a tray slide with at least one cylinder divider. By sliding the tray slide along the length of the water channel, the cylinder divider allows the user of the ice bar tray to make various lengths of ice bars. While an ice bar has a round cross section, it may also be formed having a half-round cross section or three-quarter round cross section. The ice bars formed using the subject ice bar tray, by the nature of their length and cross section, provide additional cooling of water in various types of water containers over an extended period of time. The ice bars make loading a water bag with ice quicker and easier because of the larger and longer bars when compared to singular ice cubes.

These and other objects of the present invention will become apparent to those familiar with ice making devices from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which:

FIG. 1 is a perspective view of the subject ice bar tray having four parallel elongated bar cylinders with a tray handle on both ends. Each cylinder has elongated openings in the top thereof for receiving water therein and for discharging frozen ice bars formed in each cylinder.

FIG. 2 is a cross sectional view of the ice bar tray taken along lines 2—2 shown in FIG. 1. In this view two of the cylinders are shown having round ice bars formed therein. A third cylinder is shown with a three-quarter round ice bar formed therein. A fourth cylinder is shown with a half-round ice bar formed therein.

FIG. 3 illustrates a side view of the ice bar tray with a user of tray removing one of the ice bars from a bar cylinder in the tray.

FIG. 3A is a cross sectional view taken along lines 3A—3A shown in FIG. 3. In this view, one of the bar cylinders is flexed into an open position for removing the frozen ice bar from the cylinder.

FIG. 4 is a front view of a tray slide with cylinder dividers suspended therefrom. The dividers are used for receipt in the elongated bar cylinders. By sliding the tray slide along the length of the bar cylinders, various lengths of ice bars can be formed in the bar cylinders.

FIG. 5 is a perspective view of a popular type of water bag used by hikers, campers, bike riders and others. In this drawing, an elongated ice bar formed using the ice bar tray is inserted into a circular water fill opening in the top of the water bag.

DESCRIPTION OF THE PREFERRED EMBODIMENTS

In FIG. 1, a perspective view of the subject ice bar tray is illustrated. The ice bar tray is shown having a general reference numeral 10. In this example, the tray 10 includes four parallel elongated bar cylinders 12 with a tray handle 14 on each end of the tray 10. While the tray 10 is shown with four bar cylinders 12, it can be appreciated that any number of cylinders having different lengths, different diameters and different cross sections be may incorporated into the subject ice bar tray 10 without departing from the spirit and scope of the invention.

Each cylinder 12 has an elongated opening 16 along the top thereof for receiving water therein. The pouring of water into the openings 16 is illustrated using arrows 18. The water, when poured through the openings 16, is received in elongated water channels 20. The water channels 20 can be seen in cross section in FIG. 2. When the water is frozen in the water channels 20, a completed ice bar 22 is discharging outwardly through the elongated opening 16 as shown in the left side of FIG. 1. The ice bar 22 is shown having a round cross section.

In FIG. 2, a cross sectional view of the ice bar tray 10 is shown taken along lines 2—2 shown in FIG. 1. In this view, two of the elongated bar cylinders 12 on the left are shown having formed ice bars 22 with a round cross section. A completely round cross sectional ice bar 22 obviously provides a greater surface area for additional cooling of water in a water container. A third bar cylinder 12 is shown with a three-quarter round ice bar 22 formed therein. This is accomplished by not completely filling the elongated water channel 20 with water. A fourth bar cylinder 12 on the right is shown with a half-round ice bar 22 formed therein.

In FIG. 3, a side view of the ice bar tray 10 is shown with a hand 21 of the user of the tray removing one of the ice bars 22 from a bar cylinder 12 in the tray 10. Also shown in this drawing is the other hand 23 of the user holding on to the handle 14 of the tray 10 and pushing downward, as indicated by arrow 25, for helping release the ice bar 22 from the cylinder 12.

In FIG. 3A, a cross sectional view taken along lines 3A—3A shown in FIG. 3 is illustrated. In this drawing, one of the bar cylinders 12 is shown flexed, as indicated by arrows 24, with pressure applied to the bottom of the tray 10, as indicated by arrows 26, into an open position. The pressure as shown by arrows 26 can be applied by pushing downwardly on the handle 14 as shown in FIG. 3. In this manner, the ice bar 22 formed in the elongated water channel 20 is released, as indicated by arrow 28, through the elongated opening 16. The ice bar tray 10 may be made of a flexible PVC plastic and like materials.

In FIG. 4, a front view of a unique tray slide 30 is shown having a slide bar 32 with cylinder dividers 34 suspended from the slide bar 32. The cylinder dividers 34 are used for receipt in the elongated water channels 20. By sliding the tray slide 30 along the length of the bar cylinders 12, various lengths of ice bars 22 can be formed inside the water channels 20. For example, ice bars 22 may vary in length from 3 inches, 6 inches, 9 inches, 12 inches and greater depending on the size of the water container receiving the ice bars. Also, the cross section of the ice bars may vary from slightly less than 1 inch in diameter, less than 1 ½ inch in diameter and greater depending on the size of a water fill opening in the water container. Obviously, the length and diameter of the ice bar 22 can vary depending on the size and shape of the water container and the fill opening in the container.

In FIG. 5, a perspective view of a popular type of back pack type water bag 36 is shown. This type of water bag 36 is used by hikers, campers, bike riders and others. The water bag 36 includes back straps 38, a water hose 40, a mouth piece 42 for receiving water from inside the bag 36 and a circular fill opening 44 with fill opening cover 46. While water bag 36 is shown in this drawing, it can be appreciated that the ice bars 22 made using the subject invention can be used with various types of water bags, water bottles and other types of liquid containers with different types and sizes of fill openings.

In this drawing, an elongated ice bar 22, formed using the subject ice bar tray 10, is shown being inserted, as indicated by arrow 48, into the circular water fill opening 44 in the top of the water bag 36. For example, the water fill opening 44 may have a diameter of 1 ½ inch. Therefore, the diameter of the ice bar 22, formed in the ice bar tray 10, would be have a diameter of slightly less than 1 ½ inch and would easily slip through the fill opening 44 and into the interior of the water bag 36. Further, depending on the size and shape of the water bag 36, a plurality of ice bars 22 can be received inside the water bag 36 and placed parallel to each other for greater cooling of the water stored therein and for an extended period of time.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An ice bar tray for receiving water therein, for freezing the water and making a circular ice bar of a selected length and diameter, the ice bar used in different types and sizes of water containers, the ice bar tray comprising:

an elongated horizontal ice bar cylinder made of flexible material, said ice bar cylinder having a length and an inner diameter, said ice bar cylinder having closed ends; and an expandable cylinder opening in a top portion of said ice bar cylinder, said cylinder opening extending released length o said ice bar cylinder, said cylinder opening adapted for receiving the water therethrough and into and along the length of said ice bar cylinder, the top portion of said ice bar cylinder having flexible sides along a length of opposite sides of said cylinder opening;

whereby said flexible sides allowing said cylinder opening to be expanded to the diameter of the ice bar formed inside said ice bar cylinder so that the ice bar can be released upwardly and outwardly from said ice bar cylinder.

2. The ice bar tray as described in claim 1 further including a plurality of elongated ice bar cylinders with cylinder openings along a top portion of said ice bar cylinders, said ice bar cylinders disposed parallel to each other and attached to a tray handle.

3. The ice bar tray as described in claim 2 wherein said elongated ice bar cylinders are attached to each other along a length of said ice bar cylinders.

4. The ice bar tray as described in claim 1 further including a tray slide having a cylinder divider, said cylinder divider received inside said ice bar cylinder for dividing the length of said ice bar cylinder.

5. The ice bar tray as described in claim 1 wherein said ice bar cylinder is made of a flexible plastic material.

6. An ice bar tray for receiving water therein, for freezing the water and making a circular ice bar of a selected length and diameter, the ice bar used in different types and sizes of water containers, the ice bar tray comprising:

a plurality of elongated parallel horizontal ice bar cylinders attached to each other, said ice bar cylinders having a length and an inner diameter, said ice bar cylinders having closed ends; and an expandable cylinder opening in a top portion of each of said ice bar cylinders, said cylinder openings extending along the length of said ice bar cylinders, said cylinder openings adapted for receiving the water therethrough and into and along the length of said ice bar cylinders; the top portion of said ice bar cylinders having flexible sides along a length of opposite sides of said cylinder opening, said flexible sides allowing said cylinder openings to be expanded to the diameter of the ice bar formed in the inner diameter of said ice bar cylinders so that the ice bars formed therein can be released upwardly and outwardly from said ice bar cylinders.

7. The ice bar tray as described in claim 6 wherein said ice bar tray includes tray handles attached to opposite ends of said ice bar cylinders, said tray handles used for holding and flexing said ice bar cylinders when releasing ice bars therefrom.

8. The ice tray as described in claim 6 further including a tray slide having a plurality of cylinder dividers, said cylinder dividers slidably received inside said ice bar cylinders for dividing the length of each of said ice bar cylinders.

9. The ice bar tray as described in claim 6 wherein said ice bar cylinders are made of a flexible plastic material.

10. An ice bar tray for receiving water therein, for freezing the water and making a circular ice bar of a selected length and diameter, the ice bar used in different types and sizes of water containers, the ice bar tray comprising:

a plurality of elongated parallel horizontal ice bar cylinders attached to each other and made of flexible material, said ice bar cylinders having a length and an inner diameter, said ice bar cylinders having closed ends;

a pair of handles, said handles attached to opposite ends of said ice bar cylinders; and an expandable cylinder opening in a top portion of each of said ice bar cylinders, said cylinder openings extending along the length of said ice bar cylinders, said cylinder openings adapted for receiving the water therethrough and into and along the length of said ice bar cylinders, the top portion of said ice bar cylinders having flexible sides along a length of opposite sides of said cylinder opening, said flexible sides allowing said cylinder openings to be expanded to the diameter of the ice bar formed in the inner diameter of said ice bar cylinders so that the ice bars formed therein can be released upwardly and outwardly from said ice bar cylinders.

* * * * *